US007954291B2

(12) United States Patent
Cretti

(10) Patent No.: US 7,954,291 B2
(45) Date of Patent: Jun. 7, 2011

(54) COMPOSITE ARTICLE FOR CONSTRUCTING FLOORS

(75) Inventor: Piero Cretti, Morbio Superiore (CH)

(73) Assignee: Plastedil S.A., Chiasso (CH)

( * ) Notice: Subject to any disclaimer, the term of this patent is extended or adjusted under 35 U.S.C. 154(b) by 530 days.

(21) Appl. No.: 12/142,268

(22) Filed: Jun. 19, 2008

(65) Prior Publication Data

US 2008/0313990 A1 Dec. 25, 2008

(30) Foreign Application Priority Data

Jun. 19, 2007 (IT) ..... VA2007A000053

(51) Int. Cl.
*E04B 1/19* (2006.01)
*E04C 1/00* (2006.01)

(52) U.S. Cl. ..... 52/309.16; 52/332; 52/309.12; 52/649.1

(58) Field of Classification Search ..... 52/309.16, 52/414, 745.19, 309.12, 332, 309.17, 432, 52/309.7, 341, 649.1, 649.2, 649.8, 309.8, 52/309.9, 334
See application file for complete search history.

(56) References Cited

U.S. PATENT DOCUMENTS 1,941,221 A * 12/1933 Odgers ..... 30/164.95
3,382,637 A * 5/1968 Enrico ..... 52/320
4,128,975 A * 12/1978 Abate ..... 52/125.4
4,157,640 A * 6/1979 Joannes ..... 52/309.7
4,272,230 A * 6/1981 Abate ..... 425/64
4,566,240 A * 1/1986 Schilger ..... 52/414
4,811,770 A * 3/1989 Rapp ..... 52/309.12
5,333,429 A * 8/1994 Cretti ..... 52/309.7
5,381,635 A * 1/1995 Sanger ..... 52/251
5,809,725 A * 9/1998 Cretti ..... 52/426
5,930,965 A * 8/1999 Carver ..... 52/320
6,298,622 B1 * 10/2001 Cretti ..... 52/309.7
6,955,014 B2 * 10/2005 LeJeune et al. ..... 52/223.6
7,666,258 B2 * 2/2010 Guevara et al. ..... 106/724
7,784,235 B2 * 8/2010 Cretti ..... 52/332
7,790,302 B2 * 9/2010 Ladely (Guevara) et al. ..... 428/703
7,814,719 B2 * 10/2010 Cretti ..... 52/340
2004/0074022 A1 * 4/2004 Tokuno et al. ..... 14/73
2006/0075701 A1 * 4/2006 Cretti ..... 52/223.8
2006/0075707 A1 * 4/2006 Cretti ..... 52/414
2008/0041004 A1 * 2/2008 Gibbar et al. ..... 52/309.12

FOREIGN PATENT DOCUMENTS

WO WO2005108700 * 11/2005
WO WO2005/121467 * 12/2005

* cited by examiner

*Primary Examiner* — Richard E Chilcot, Jr.
*Assistant Examiner* — Mark R Wendell
(74) *Attorney, Agent, or Firm* — Connolly Bove Lodge & Hutz LLP

(57) ABSTRACT

A composite for constructing concrete floors is completely factory assembled and comprises a body of expanded plastic having at least two parallel channels, open on the upper surface of the panel, extending the length of the article, adapted to be filled with concrete. A steel reinforcement bar fabric is installed into each channel, which may comprise at least two parallel steel bars connected by cross bars. At least some cross bars extend beyond a lowest reinforcement fabric bar to provide spikes long enough to pass through the plastic bottom and protrude therefrom. One or more sheet metal shrouds with at least one row of aligned holes matching those of the protruding spike ends are applied to the underside surface of the plastic body hung from the protruding ends of the spike by fasteners

14 Claims, 4 Drawing Sheets

COMPOSITE ARTICLE FOR CONSTRUCTING FLOORS

TECHNICAL FIELD

This disclosure relates in general to manufactured articles for constructing floors of buildings and in particular panels of expanded plastic material having channels adapted to accommodate spacingly supported reinforcement steel bars for forming parallel load bearing reinforced concrete ribs and eventual transversal stiffening ribs, upon consolidation of a concrete filling poured over the laid panels and reinforcement structures.

DISCUSSION OF BACKGROUND ART

The technique of stay-in-build insulating concrete forming systems for joisted concrete floors employing channeled panels of expanded plastic associated with reinforcement steel bars of load bearing ribs, realized upon the consolidation of poured concrete filling channels defined in the expanded plastic panels for accommodating reinforcement bar fabrics is well-known and commonly practiced in the concrete building industry.

The publications WO 2005/108700-A1 and WO 2005/121467 A2, both to Cretti and assigned to the assignee of this application, disclose significant examples of such a technique for constructing floors as an alternative to the traditional technique employing pre-fabricated load bearing reinforced concrete beams and bridging hollow floor bricks laid there between.

The high degree of automation that is practicable in producing panels of expanded plastic, metal elements of self standing and/or reinforcement steel bar fabrics for the concrete ribs to be formed, the lightness of the expanded plastic panels compared to the traditional materials used for constructing floor such as pre-fabricated reinforced concrete beams and hollow floor bricks, significantly reduce the costs of transportation and for laying the panels and the reinforcement steel bar fabrics over which concrete is eventually poured. This technique simplifies the construction of floors at sensibly reduced cost and enhances acoustic and thermal isolation characteristics.

Labor cost in laying the expanded plastic panels and the reinforcement metal structures (fabrics) into channels defined in the expanded plastic panels and of eventual other metallic elements for providing adequate self-standing properties of the laid panels and reinforcement structures onto which the concrete will be poured and evenly distributed, remains yet an important cost factor. Moreover, assembling and laying the distinct components at the construction site may lead to assembly imprecision that could, in the worst case, determine instability of the reinforcement metal structures within the channels defined in the body of the expanded plastic panels, during the distribution of the poured concrete.

Notably, floors constructed with this technique have a reduced ability to retard penetration of flames in the finished floor structure because of an excessive contraction of the expanded plastic bodies caused by a prolonged exposure to strong heat may lead to the peeling off of plaster coats or the falling off of the plaster boards or of other facing layer of the underside ceiling.

It is important that in case of fire, notwithstanding the fact that the expanded plastic may shrink as far as forming informal masses of reduced volume, the coats or facings of the underside ceiling, for example one or more layers of plaster or a facing of plaster boards remain in place, for retarding penetration of flames.

SUMMARY OF THE DISCLOSURE

A composite article of manufacture for constructing concrete floors has now been developed so as to be completely factory assembled for exploiting, to the fullest degree, cost saving automation facilities and achieving reliable quality control.

The factory assembled composite panels of this disclosure achieve an outstanding minimization of labor and relative costs required for laying the fully pre-assembled composite articles at the construction site and an almost complete elimination of risks of assembly errors during the preparation of the flooring platform onto which the pourable concrete will be finally distributed.

Moreover, the novel structure of the factory pre-assembled composite panels enhances the stability of coatings and facings that may be applied to the underside surface of the finished floor in case of fire, notwithstanding contraction of the expanded plastic portions.

According to a preferred embodiment, the whole underside surface of the composite article has a metal sheet shroud, the stability of which is substantially ensured even in case of fire. The metal shroud of the composite panels provides a metal facing substantially free of discontinuity over the whole underside surface of the floor.

In situations wherein particular aesthetical qualities are not required, the outer facing of metal sheet of the ceiling surface of the finished floor may even remain in sight (for example in case of ceilings of underground storage space, garages and the like).

Alternatively, the facing metal sheet of the composite article of manufacture of the present disclosure provides an anchoring element for common ceiling coats such as plaster, plaster boards and the like.

Basically, the composite panel of the present disclosure comprises a body of expanded plastic having at least two parallel channels, open on the upper surface of the panel, that extends for the whole length of the article, adapted to be filled with concrete poured over the panel. A steel reinforcement bar fabric is installed into each channel. It may comprise at least two parallel steel bars connected by at least an order of cross bars disposed at regular intervals along the length of the reinforcement fabric. At least same or preferably all of the cross bars extend beyond a lowest reinforcement steel bar of the fabric for constituting a plurality of spikes of length sufficient to pass through the expanded plastic bottom of the accommodating channel in order to sustain in a stable upright position inside the channel the reinforcement fabric, and to protrude from of the underside surface of the expanded plastic body.

One or more rolled or stamped sheet metal shrouds with at least one row of aligned holes spaced from one another at intervals matching those of the array of protruding spike ends are applied to the underside surface of the expanded plastic body hung from the protruding ends of the spike by fastening nuts or caps stably engaged with the ends of the metal spike body reinforcement fabric, that cover the hole of passage of the spikes.

The fastening nuts or caps may be of a sufficiently malleable metallic material capable of self threading on a helicoidal thread formed in the end position of the metal spikes or of a plastic material having a significant resistance to fire, such as for example a polytetrafluoroethylene or similar material.

Preferably, before installing the reinforcement bar fabric into a channel of the expanded plastic body, appropriate spacing counter caps of the same material of the fastening caps or even of different material are slipped over the metal spikes in order to enhance stabilization of the reinforcement bar fabric and keep it in a precisely upright position inside the receiving channel, spaced from the bottom surface of the channel in the expanded plastic body in which it is disposed.

The invention is defined in the annexed claims.

DESCRIPTION OF SEVERAL EMBODIMENTS OF THE DISCLOSURE

Figure 2:
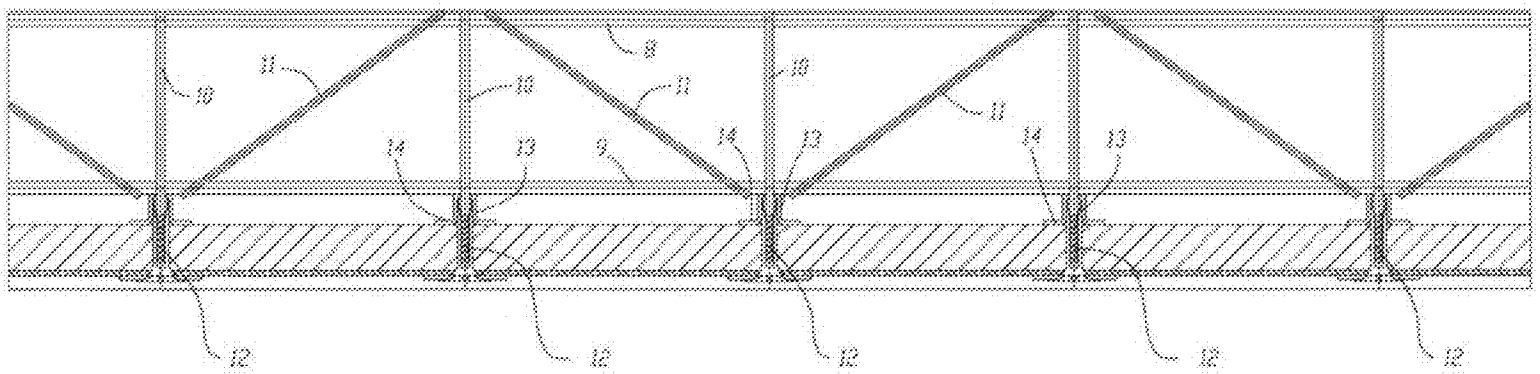
FIG. 2 is a longitudinal view of an exemplary reinforcement bar fabric to be laid inside a receiving channel of the expanded plastic body.

The following detailed description of several embodiments shown in the drawings, does not exclude in any way other possible forms of realization of the composite article of manufacture of the present disclosure.

In the exemplary embodiments shown, the expanded plastic body of each composite panel has two parallel channels open on the upper side of the expanded plastic body that extend for the whole length, which will eventually be filled by a poured concrete mix. Of course, each expanded plastic body may have more than two panel open channels for realizing more than two load bearing reinforced concrete beams, according to design choices, having a proportionately greater width and even a different arrangement of longitudinal cavities for reducing the mass of expanded plastic material.

Figure 1:
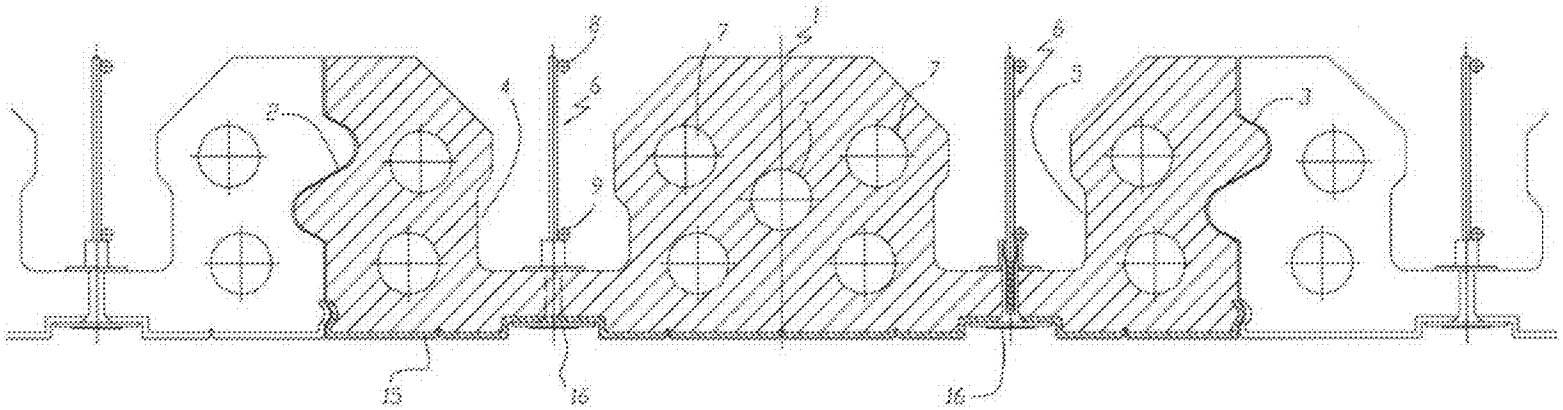
FIG. 1 is a cross sectional view of a composite article of manufacture of the present disclosure.

With references to FIGS. 1 and 2, a composite article of manufacture of the present disclosure is comprised of a body of expanded plastic 1 of a generally elongated parallelepiped shape, with longitudinal flank profiles 2 and 3 shaped in a way as to be juxtaposed by tonguing one with the other, according to common practices used in the industry. Longitudinal cavities 7 for reducing the mass of expanded plastic and provide longitudinal passages for tubes or cables may also be present according to common fabrication practices of these elements.

In the shown example, the expanded plastic body 1 defines two parallel open channels 4 and 5 inside in which reinforcement bar fabrics 6 for load bearing beams to be formed upon consolidation of poured concrete mix are pre-installed at the factory.

In the shown example, the reinforcement fabrics 6 include a reinforcement upper steel bar 8, a reinforcement bottom steel bar 9, an order of steel cross bar 10 and an order of stiffening spacer steel bars 11.

Preferably as shown, all of the cross bars 10 extend well beyond the lower bar 9 of the reinforcement fabric 6 for constituting as many spikes 12 of length sufficient to pass through the bottom of expanded plastic of the reinforcement fabric accommodating channel, as far as reaching close to or slightly protruding out of the underside surface of the expanded plastic body 1.

As shown in FIGS. 1 and 2, the expanded plastic bottom of the channel may already be provided with holes at regular intervals such to receive there through the spikes 12. Alternatively, the assembly of the composite article may contemplate piercing of the expanded plastic of the bottom wall by the spikes 12 themselves by pushing the reinforcement metal fabric in position into the channel.

Preferably, as shown in the figures, before passing the spikes 12 through the bottom wall of the channel, spacer counter-caps 13, preferably of a plastic material each having an end flange 14 for resting over the bottom surface of the expanded plastic of the channel accommodating the reinforcement fabric are slipped over the spikes 12.

Figure 3:
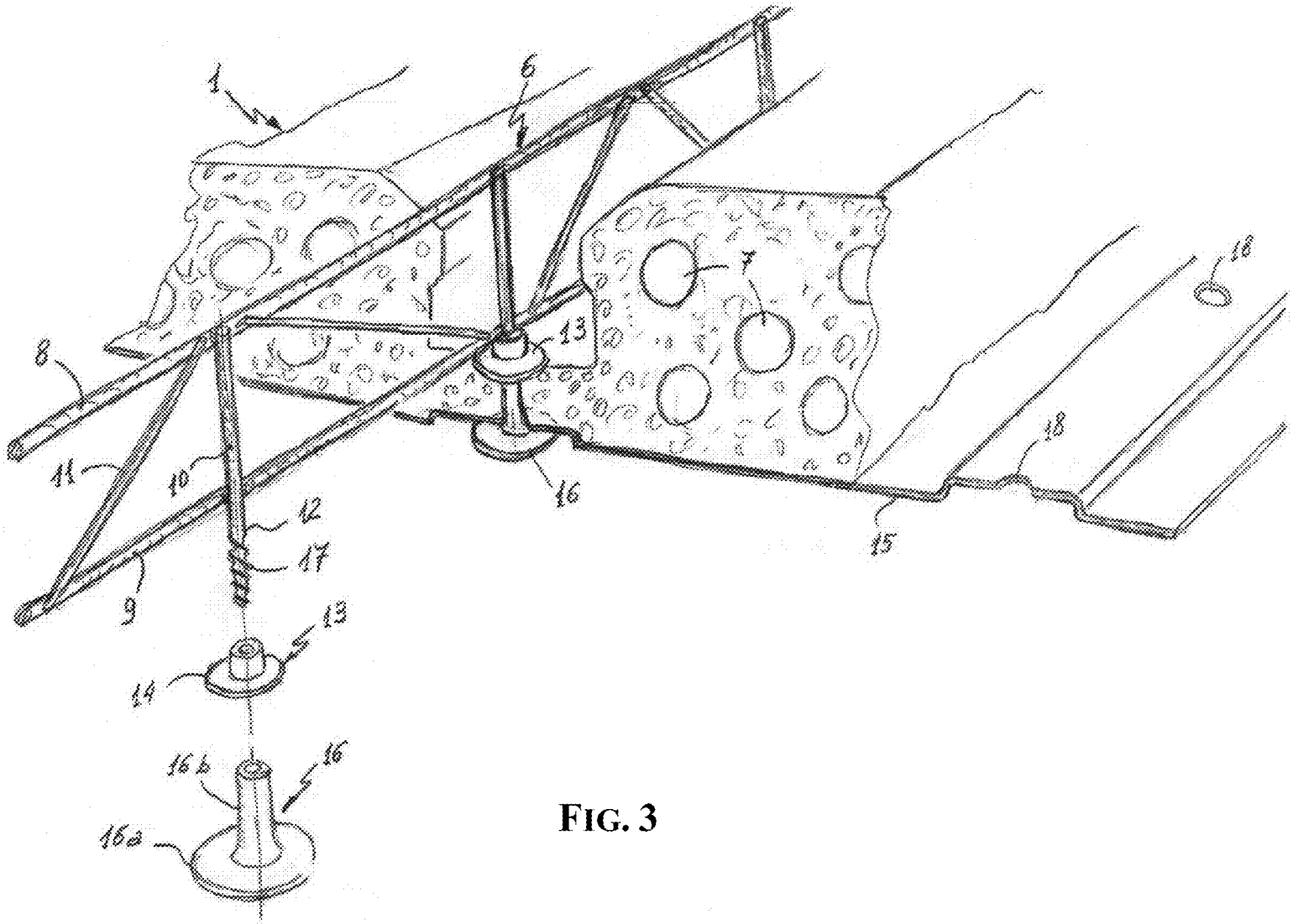
FIG. 3 shows the assembly of the three main components of the composite structure of the article of manufacture.

Over the underside surface of the expanded plastic body 1 is then applied a rolled or stamped sheet metal shroud 15, as illustrated in FIG. 3, that may have upward bent side edges adapted to wrap around the lower corners of the expanded plastic body all along its flanks.

The rolled or alternatively press stamped sheet metal 15 has longitudinally aligned holes with the same pitch (uniform spacing distance) of the axis of the spikes 12 and its rolled or press formed profile matches the profile of the lower surface of the expanded plastic body.

Fastening nuts or caps 16 having an end flange and a tubular stem stably engage with the ends of the spikes 12, on which they are tightened so as to provide for a stable connection between the reinforcement fabric 6 and the sheet metal shroud 15 applied onto the underside surface of the manufactured article. The sheet metal shroud 15 thus coupled to the expanded resin body confers to the composite an enhanced self-standing capability by acting as a stiffening and protecting armature that permit safe handling, transportation and laying of the factory pre-assembled composite panel.

The tightening of the fastening caps 16 effectively stabilizes the positioned reinforcement fabric 6 as well as the stiffening metal sheet shroud 15 coupling with the expanded plastic body, making it possible to handle with ease the fully assembled composite panels without risk of damaging them, to transport them from the factory to the construction site to be easily and quickly laid for constructing the floor platform, by simply juxtaposing one composite panel to the other over a temporary scaffold.

The way in which the three essential components of the composite article of manufacture of the present invention namely, the expanded plastic body 1, the reinforcement metal fabric 6 and the stiffening sheet metal shroud 11, are assembled to form a composite article suitable to be stored, transported and laid at the construction site is graphically illustrated in FIG. 3.

Preferably, as in the example shown in FIG. 3, the ends of the spikes 12 are provided with an helicoidal profile 17.

The spacing counter-cap 13 is forcibly slipped along the full extension length of the spike.

The spacing counter-cap 13 may be made of a malleable plastic having a through hole of diameter slightly interfering with the outer diameter of the threaded end of the spike 12, in order to make it possible to slip it over even by actually forcing it over the spike 12, as far as abutting against the lower reinforcement bar 9, and be thus retained in place by being unable to fall or drop off by gravity.

The steel bar reinforcement fabric 6, optionally pre-equipped with the spacer counter-caps 13, may be installed into the receiving channel eventually by forcing the spikes 12 to pierce through the thickness of expanded plastic at the bottom of the channel as far as bearing with the flanged end 14 of the spacers 13 over the bottom of the channel. Any other effective way of maintaining the lower bar of the reinforcement fabric spaced by a certain distance from the bottom of the channel that will be eventually filled by the poured concrete mix can be resorted to, for example by simply placing a few stay-in spacers of appropriate shape on the bottom of the channel before placing and fastening in place the reinforcement fabric.

The assembly is completed upon tightening the fastening caps 16, having a terminal flange 16*a* and a tubular stem 16*b*. The axial hole diameter of the caps is smaller than the outer diameter of the helix 17 at the end 17 of the spike 12, for self-threading and tightening of the fastening caps 16. The fastening caps 16 may be of malleable metallic material or of a plastic material capable of resisting relatively high temperatures and sufficiently malleable in order to permit self-threading over the helicoidal end 17 of the steel spike 12.

The end flange 16*a*, besides sustaining the sheet metal shroud 15 so connected to the reinforcement fabric 6 of the load bearing beam has also the function of covering the hole through the shroud and the piercing through the expanded plastic bottom of the channel in which will be formed the load bearing reinforced concrete beam of the floor.

Instead of a helicoidal self-threading, any other type of mechanical fastening capable of ensuring an adequate resistance to the tensile stress may be used for fixing (hanging) the sheet metal shroud 15 to the reinforcement fabric of the overhanging beam.

Figure 4:
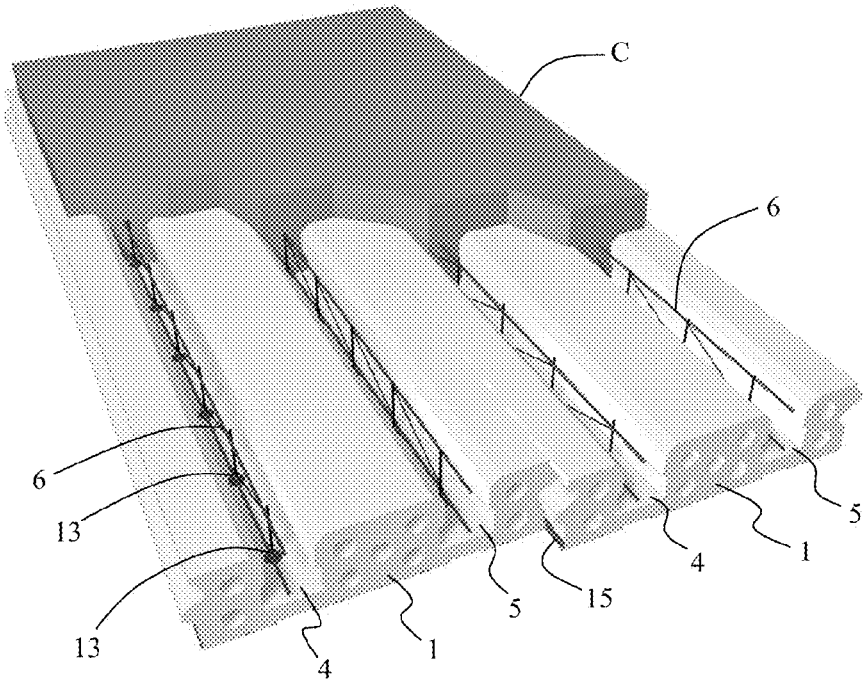
FIGS. 4 and 5 are three-dimensional photographic renderings showing the structure of the composite article of the present disclosure according to a first exemplary embodiment.
Figure 5:
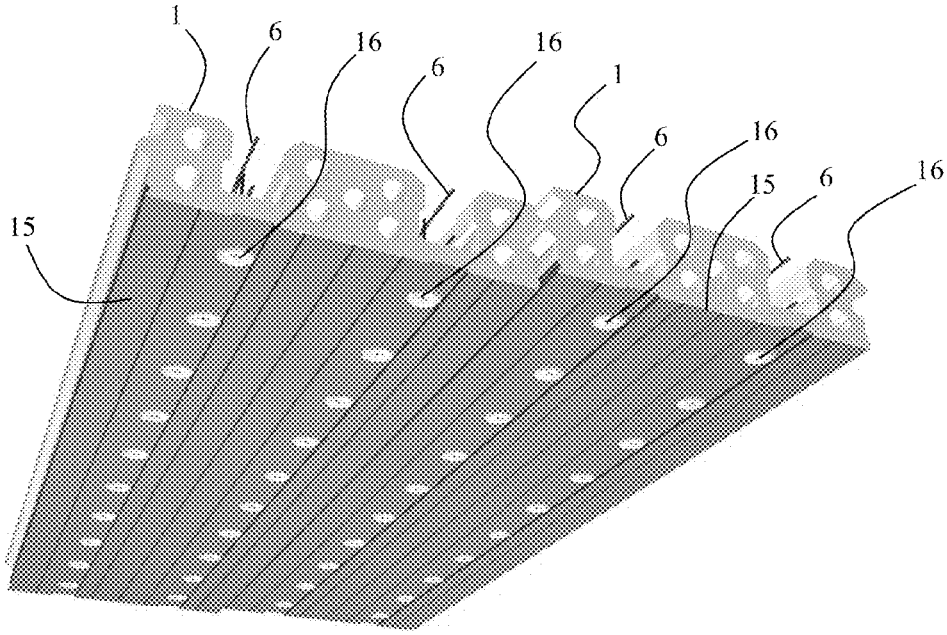

FIGS. 4 and 5 are perspective views from above and from below that illustrate two composite articles of manufacture of FIGS. 1 and 2 juxtaposed one next to the other along their flanks in forming the floor platform on which a layer of C concrete will then be poured.

Figure 6:
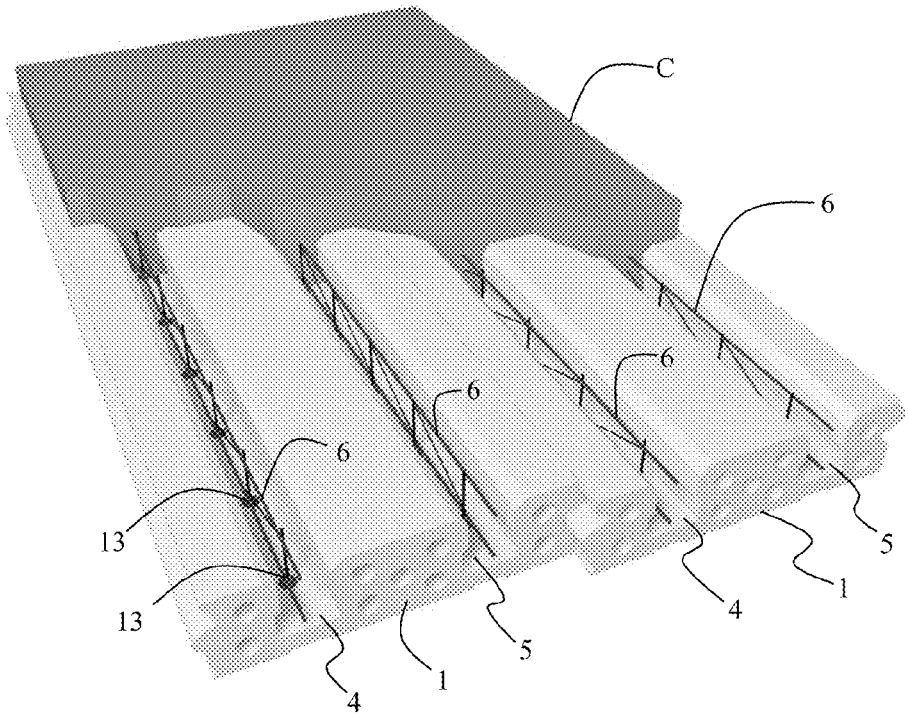
FIGS. 6 and 7 are three-dimensional photographic renderings of the structure of a composite article of manufacture of the present disclosure according to a different exemplary embodiment.
Figure 7:
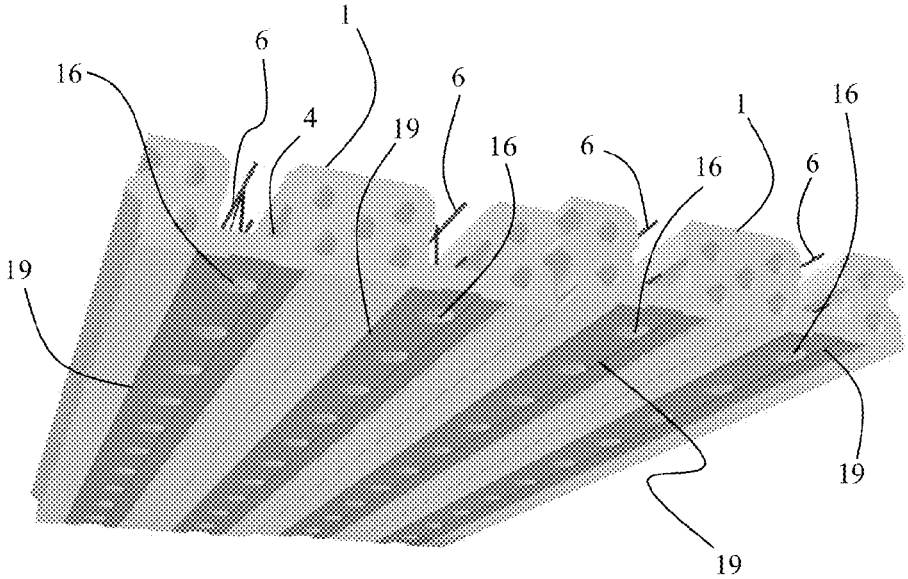

FIGS. 6 and 7 illustrate an alternative embodiment of the composite article of the present disclosure wherein, instead of a single stiffening sheet metal shroud covering the whole underside surface of the composite article and provided of at least two parallel rows of aligned fastening holes, each composite article comprises two distinct parallel extending sheet metal shrouds, respectively under one and under the other of the two channels 4 and 5 in which two load bearing beams will be formed.

In this case, each metal shroud 19 has only one row of spaced holes for suspending it to the respective beam by virtue of its mechanical connection to the reinforcement fabric 6 of the beam through the spikes 12, the spacer under caps 13 and the fastening caps 16.

In any case, the single sheet metal shroud 15 or the two parallel shrouds 19 provide structural elements for fixing eventual coats of the ceiling, for example of plaster boards, that will remain in place even in the event of a partial of an extended deformation of the expanded plastic body 1, because securely fastened to the load bearing beams of the floor.

In case of the preferred embodiments of FIGS. 1-5, the whole underside surface of the finished floor will be covered by sheet metal, substantially without any discontinuity. In many cases, the aspect of the finished floor will be adequate to the specific technical requisites even from an aesthetical point of view and in any case the uninterrupted sheet metal coat will itself contribute to retard propagation of flames representing a secondary (if not the sole) barrier to propagation of flames into and through the floor.

According to a preferred embodiment, the materials that may be satisfactorily used are indicated here below:

- the expanded plastic may be a self-extinguishing expanded polystyrene normal or γ-enhanced, having a density from about 18 to about 30 $Kg/m^3$, eventually sintered in the desired profile form in a continuous process;
- the reinforcement metal fabric may be of common steel reinforcement bars for concrete such as, for example, the commercial product designed FeB44K;
- the self-standing enhancement shrouds coupled to the underside surface of the expanded plastic body may be of a preformed steel sheet, preferably galvanized or pre-varnished, having thickness generally about 0.3 to about 0.8 mm, or a pre-formed sheet of copper or of aluminum of adequate mechanical properties, or an extruded aluminum profile;
- the fastening nuts or caps may be of low carbon iron, aluminum, polyethylene, polypropylene, ABS, polyamides such as Nylon™, polytetrafluoroethylene such as Teflon™ or other malleable material;
- the counter-cap spacers may be of polystyrene, polyethylene, polypropylene, ABS or other plastic material of similar properties.

Of course, even different materials with mechanical and thermal characteristics similar to those indicated above may be used for meeting peculiar requirements, in function of the type of building and of its contemplated use.

The term "comprising" (and its grammatical variations) as used herein is used in the inclusive sense of "having" or "including" and not in the exclusive sense of "consisting only of" The terms "a", "an" and "the" as used herein are understood to encompass the plural as well as the singular.

All publications, patents and patent applications cited in this specification are herein incorporated by reference, and for any and all purpose, as if each individual publication, patent or patent application were specifically and individually indicated to be incorporated by reference. In the case of inconsistencies, the present disclosure will prevail.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A composite article of manufacture for constructing floors comprising:

- an expanded plastic body having at least two parallel channels open on an upper face and extending for the whole length of the article, adapted to receive a pourable concrete mix;
- a metal reinforcement fabric in each of said channels, comprising at least two reinforcement bars connected by at least an order of cross bar spacers at intervals along the length of the article, at least part of said cross bar spacers, extending beyond the lower reinforcement bar of the metal fabric for constituting a plurality of spaced spikes of length sufficient to pass through the expanded plastic bottom of the channel for sustaining in a stable position said metal reinforcement fabric and emerge from the underside surface of the expanded plastic body;

one or more stiffening sheet metal shrouds with either one or at least two rows of aligned holes at said intervals, for engaging with and connecting to the ends of said spikes by fastening caps that close the respective hole.

2. The composite article according to claim 1, wherein the ends of said metal spikes have a helicoidal profile.

3. The composite article according to claim 1, wherein said fastening caps are of a self-threading malleable material.

4. The composite article according to claim 1, further comprising spacer counter-caps slipped over said spikes before introducing said reinforcement metal fabric in the channel and having a height adapted to sustain the lowest reinforcement bar of said metal fabric at a certain distance from the surface of the expanded plastic bottom of the receiving channel.

5. The composite article according to claim 1, wherein said reinforcement metal fabric has a planar structure comprising two parallel reinforcement bars, respectively upper and lower, an order of cross bars and an order of inclined spacing bars between cross bars.

6. The composite article according to claim 1, comprising a single pre-formed sheet metal shroud having two or more parallel rows of aligned holes for engaging with and being hung to parallel rows of spikes of said reinforcement metal fabrics and longitudinal edges folded upward for wrapping around the two lower corners of flanks of the expanded plastic body.

7. The composite article according to claim 1, wherein a distinct pre-formed sheet metal shroud is applied underneath each channel for formation of a load bearing beam and has a single row of aligned holes for mechanically connecting to the respective reinforcement metal fabric of the beam, extending parallel to and spaced from at least a similar sheet metal shroud applied underneath an adjacent load bearing beam.

8. The composite article according to claim 1, wherein said expanded plastic is fire resistant polystyrene having a density of about 18 to about 30 $Kg/m^3$.

9. The composite article according to claim 1, wherein said pre-formed sheet metal shrouds are of steel sheet either galvanized or pre-varnished, of a thickness of about 0.3 to about 0.8 mm.

10. The composite article according to claim 1, wherein said fastening caps are of a material selected from the group consisting of low carbon iron, aluminum, polyethylene, polypropylene, ABS, polyamide and polytetrafluoroethylene.

11. The composite article according to claim 1, wherein said expanded plastic body has a generally elongated parallelepiped shape with longitudinal flank profiles adapted to be juxtaposed by tonguing with another like composite article.

12. The composite article according to claim 1, wherein said expanded plastic body comprises longitudinal cavities.

13. A method for making the composite article according to claim 1, which comprises obtaining an expanded plastic body having at least two parallel channels open on an upper face and extending for the whole length of the article, adapted to receive a pourable concrete mix;

installing a metal reinforcement fabric in each of said channels, comprising at least two reinforcement bars connected by at least an order of cross bar spacers at intervals along the length of the article, at least part of said cross bar spacers, extending beyond the lower reinforcement bar of the metal fabric for constituting a plurality of spaced spikes of length sufficient to pass through the expanded plastic bottom of the channel for sustaining in a stable position said metal reinforcement fabric and emerge from the underside surface of the expanded plastic body;

applying one or more stiffening sheet metal shrouds with either one or at least two rows of aligned holes at said intervals;

and engaging with and connecting said one or more stiffening sheet metal shrouds to the ends of said spikes by fastening caps that close the respective hole.

14. A method of constructing a concrete floor which comprises obtaining at two composite articles according to claim 1, juxtaposing one composite article next to another composite article over a temporary scaffold, and then pouring a concrete mix over the juxtaposed articles.

* * * * *